US007216564B2

(12) United States Patent
Broderick

(10) Patent No.: US 7,216,564 B2
(45) **Date of Patent: *May 15, 2007**

(54) MACHINERY SLOT COVER

(76) Inventor: Clifford Broderick, 109 Barnes Rd., Washingtonville, NY (US) 10992

( * ) Notice: Subject to any disclaimer, the term of this patent is extended or adjusted under 35 U.S.C. 154(b) by 0 days.

This patent is subject to a terminal disclaimer.

(21) Appl. No.: 10/931,136

(22) Filed: Aug. 31, 2004

(65) Prior Publication Data

US 2005/0039568 A1 Feb. 24, 2005

Related U.S. Application Data

(62) Division of application No. 09/548,706, filed on Apr. 13, 2000, now Pat. No. 6,786,110.

(60) Provisional application No. 60/129,587, filed on Apr. 16, 1999.

(51) Int. Cl.
*G05G 1/00* (2006.01)
*B66F 9/18* (2006.01)

(52) U.S. Cl. ..... 74/566; 414/607

(58) Field of Classification Search ..... 74/566, 74/608; 24/585.12, 399, 400, 304; 160/235, 160/133; 165/41; 414/659; 600/443; 187/222; *B60B 30/10; B62B 3/06*

See application file for complete search history.

(56) References Cited

U.S. PATENT DOCUMENTS 3,292,804 A * 12/1966 Veneman ..... 414/659
4,026,349 A * 5/1977 Schaap ..... 165/41
4,478,314 A * 10/1984 Dorman ..... 187/237
4,625,731 A * 12/1986 Quedens et al. ..... 600/443
5,235,874 A * 8/1993 Tabellini ..... 74/608
5,351,369 A * 10/1994 Swain ..... 24/304
5,618,159 A * 4/1997 Wilson ..... 414/785
6,276,427 B1 * 8/2001 Eisner ..... 160/133
6,517,307 B1 * 2/2003 Marino ..... 414/607
6,591,888 B2 * 7/2003 Benedetti ..... 160/235
6,902,039 B2 * 6/2005 Kunch ..... 187/222

FOREIGN PATENT DOCUMENTS

JP 9-2008 * 1/1997

* cited by examiner

*Primary Examiner*—Vinh T. Luong
(74) *Attorney, Agent, or Firm*—Thomas A. O'Rourke; Bodner & O'Rourke, LLP

(57) ABSTRACT

A slot cover for an apparatus, the apparatus having a moving carriage and a member connected to the carriage which travels in a slot. The elongated hollow member is defined by a top member, a bottom member and a pair of side members. Each side member has a connection member extending therefrom and a slot cover joining the connection member. The carriage has a cover guide connected thereto which moves with the carriage. The cover guide causes the connecting member to become separated from the slot cover as the cover guide travels along the slot. The separated portion of the slot cover is pressed into engagement with the connection member as the cover guide continues to travel along the slot.

20 Claims, 6 Drawing Sheets

MACHINERY SLOT COVER

This application is a divisional application of U.S. application Ser. No. 09/548,706 which was filed on Apr. 13, 2000 now U.S. Pat. No. 6,786,110 which application claims priority on U.S. Provisional Application Ser. No. 60/129,587 filed Apr. 16, 1999 the disclosures of which are incorporated herein by reference.

FIELD OF THE INVENTION

The present invention relates to improvements in machinery slot covers that are used in a variety of applications including but not limited to fork lifts, medical diagnostic equipment and other applications having an arm travels along an opening or slot in a column or tube.

BACKGROUND OF THE INVENTION

Arms moving along an opening or slot in a column or tubular member are common in a number of industrial applications. One well known example of such arms is found on a fork lift truck. Another example is found in medical diagnostic devices such as some scanning equipment. In these scanning devices, for example, a patient lies on a bed and a diagnostic device on an arm travels along a path to scan the patient. Other applications include the field of robotics where a moving arm may be performing a task and travel in a slot in the device. In many of these applications there is a load bearing arm that travels along a slot or opening in a column. The arm rides on a carriage over one or more tracks or other means in the column.

One of the problems encountered in, for example, fork lift applications is the problem of dirt and debris entering the slot in the column where the arm travels ultimately causing problems in the operation of the fork lift. Fork lifts are frequently used in a warehouses or storage buildings which have a significant amount of debris and dirt present. In addition, significant amounts of dust can be generate in the working environments of these devices. These deleterious materials have a tendency to enter the slot in the column and cling to the interior of the column, thus creating undue wear on the moving parts and other problems in the operation of the arm. This problem is particularly acute where you have lubricants present on open surfaces in the interior of the column to facilitate movement of the arm in the slot. These lubricants have a tendency for attracting any dirt or debris which becomes attached to the lubricated parts due to the adhesive nature of the lubricants. This dust and debris can increase wear of critical moving parts.

Fork lifts, in many applications are also used outside where the arm and the slot are subjected to the environment, particularly moisture. In these situations the slot provides an entrance way for moisture that can cause oxidation of critical parts and reduce the useful life span of the equipment. In medical applications, besides the issue of undesirable material entering into the slot there is also the problem that the interior of the column can not be readily cleaned and disinfected. These recesses will provide a resting place for the dirt and debris that is often inaccessible. This dirt and debris will have a tendency to harbor germs that may spread throughout the facility. Similarly, in many applications where robotic arms are used there are similar issues with undesirable material entering into the slot in which the carriage travels.

In addition to these problems, there is also a major safety issue for equipment having a carriage or other mechanism traveling in a slot in a column. The unprotected opening can attract fingers and hands that could be injured if the machine is in operation while the hands are present. Many times significant forces can develop as an arm or other device travels in the slot that could crush or sever fingers caught in the slot.

One approach to solve the problem of the open slot in a column has been to provide a brush member that is attached on one side of the slot and has its bristles extend over the slot toward the other side of the slot. Alternatively, there may be a pair of brush members that are attached to each edge of the slot with their bristles extending toward the center of the slot. The brush members use the bristles of the brush as a means to block the opening and prevent foreign material from entering the slot. The brush bristles are sufficiently flexible to permit the arm mechanism to travel along the slot. The problem with the use of a brush is that the individual bristles give the illusion of sealing the opening but in reality do not. Fingers and hands can still be injured during use because the opening is still at least partially opened to the exterior. With respect to debris and foreign matter entering the slot, the fingers create a problem in that there are considerable numbers of individual bristles. Each of these bristles provides a surface for dirt and grime to rest and can create a health hazard in those applications where a clean surface is required.

It is an object of the present invention to provide a cover that effectively seals the opening of a slot in a column having a moving arm.

It is an object of the present invention to provide a cover that permits an arm to travel in a slot in a column without permitting dirt and debris to enter the slot.

It is an object of the invention to provide a cover for an opened slot containing a moving member that travels along the slot that provides protection to workers and prevents hands, and fingers, clothing tools and equipment from becoming caught in the slot.

It is an object of the invention to provide an improved fork lift having a mechanism that travels in a slot that is protected from the environment.

It is an object of the invention to provide an improved medical diagnostic device having arm that travels in a slot that is protected from the environment.

It is an object of the invention to provide a robotic arm that travels along a slot in a tubular member without permitting dirt and debris to enter the slot.

SUMMARY OF THE INVENTION

The present invention is directed to improvements in machinery slot covering mechanism that are used in a variety of applications including but not limited to fork lifts, medical diagnostic equipment and other applications having an arm travels along an opening or slot in a column or tube. According to the present invention there is an improved cover for a mechanism having an open slot along which a member travels.

A fork lift truck has a fork that travels from lowered position to pick up a load to a carrying position where the fork is raised to a suitable height. The lift assembly in a fork lift truck typically includes one or a plurality of forwardly extending fork prongs. The fork prongs are attached to carriage by an accessory mounting means. The accessory mounting means may be used for attaching the prongs or any other suitable article that can be moved by the carriage as it moves.

A mast houses a carriage that raises and lowers the accessory mounting means. The mast can be, for example, a generally tubular member or column having a pair of sidewalls that join a rear wall to a front wall. The front wall typically has an opening or slot that is frequently in the form of a narrow rectangle although other shapes are possible. The front wall forms a top member and a bottom member which are joined together by a pair of side members. The side members form the sides of the opening or slot and the top member and the bottom member form the top and bottom respectively. The length and design of the slot coupled with the size of the carriage and the mast determines the path of travel of the carriage within the mast. Extending from the first member toward the second side member is a first connection means. Extending from the second side member toward the first side member is second connection means. Joining the first and second connection means is slot cover.

The connection means each may have a securing surface for securing the connection means to the side member. The connection means has at least one connecting member that mates with a receiving member on the slot cover. Alternatively, the slot cover may have the connecting member that mates with a receiving member on the connection means. In a preferred embodiment of the invention the connection means has a three connecting members. The three connecting members are separated by receiving members. Similarly, the slot cover is provided with three connecting members in a preferred embodiment. The connecting members in the slot cover are also separated by receiving members.

As the carriage moves along the slot, the cover guide which is connected to the carriage also moves in the same direction as the carriage. The cover guide is generally a plate-like member being generally rectangular in configuration, although any suitable shape is possible. Support wings are on either side of the cover guide and provide a surface for connecting the accessory mount means to the cover guide. The cover guide is preferably designed so that the cover guide has a recessed portion in which the cover passes during movement of the carriage. As the cover guide moves along its path, the cover guide lifts the cover and causes the mated connecting members in the direction of travel to become separated from their respective receiving members. As the cover guide travels along the slot, the raised portion of the slot cover is pressed into engagement with the connection means by a pressure bar. The slot cover prevents ingress of debris and moisture into the mast thus eliminating the problem of the prior art designs. In addition, the slot cover prevents injury to hands and fingers due to the movement of the carriage in the slot.

DETAILED DESCRIPTION OF THE INVENTION

Figure 1:
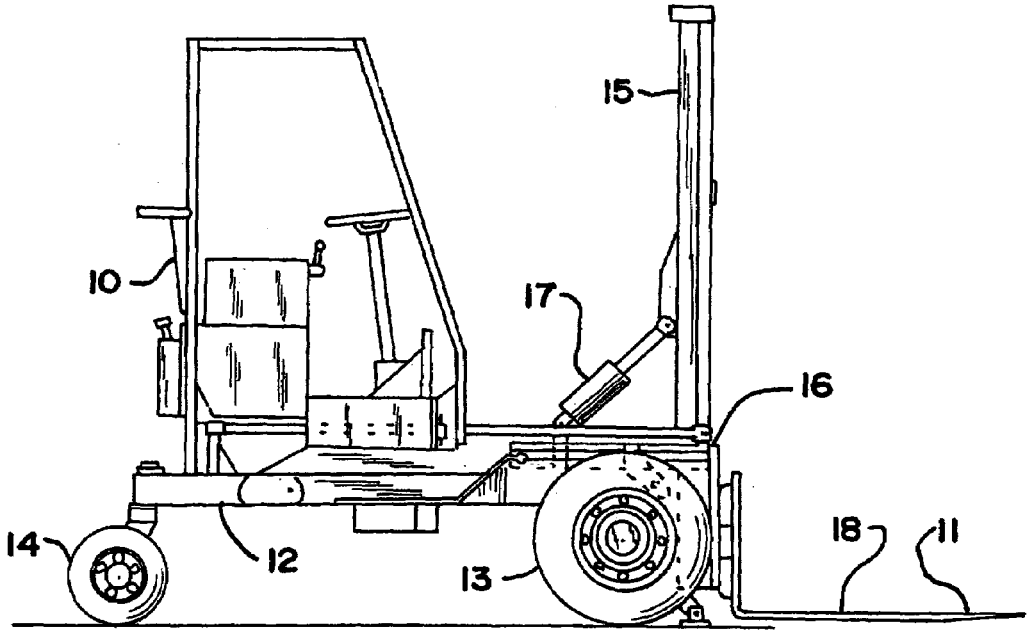
FIG. 1 shows a representative fork lift employing the cover assembly of the present invention with the forks in a lowered position.
Figure 2:
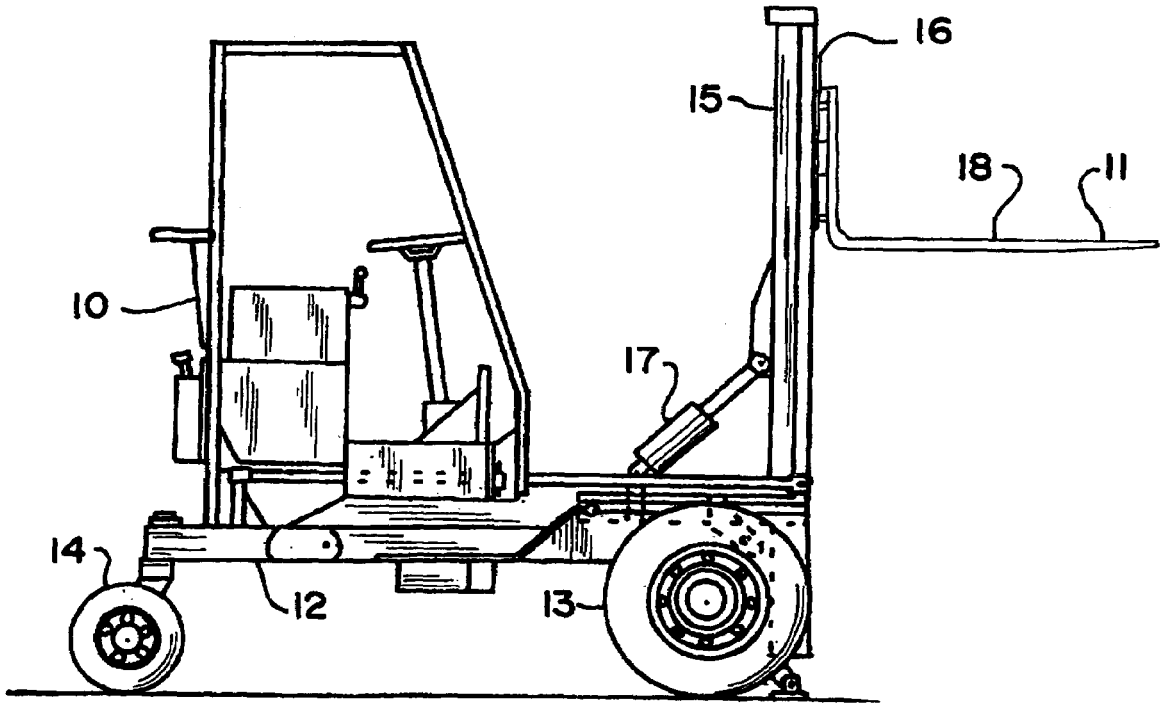
FIG. 2 shows a representative fork lift employing the cover assembly of the present invention with the forks in a lowered position.

The present invention relates to improvements in machinery slot covers that are used in a variety of applications including but not limited to fork lifts, medical diagnostic equipment and other applications having an arm travels along an opening or slot in a column or tube. The present invention has particular application in the field of fork lift trucks. As shown in FIG. 1 there is a representative fork lift truck 10 that has its fork 11 in its forward lowered position to pick up a load. The invention may also be used on other types of forklift trucks besides the type shown in FIG. 1 and the invention is not intended to be limited by the type fork lifts or other equipment it is being used. FIG. 2 shows the fork retracted to a carrying position and raised to a suitable height. The fork lift truck includes a generally U-shaped frame 12 having a pair of driven wheels 13 on the front and a caster wheel 14 on the back. The two legs of the U-shaped frame extending forwardly are aligned generally parallel to each other to support the mast 15 and carriage 16 as it is reciprocated forwardly and backwardly by for example a piston and cylinder combination 17. A seat is mounted on the frame usually near the caster wheel 14 and the various components for steering the fork lift and providing elevational control are mounted in proximity to the seat. The lift assembly includes one or a plurality of forwardly extending fork prongs 18. The fork prongs are attached to carriage 16 by means of an accessory mounting means 19. The accessory mounting means 19 may be used to attach the prongs or any other suitable article that can be moved by the carriage 16 as it travels.

The mast 15 which houses the carriage 16 may be, for example, a generally tubular member or column having a pair of sidewalls 20 and 20A that join rear wall 21 to front wall 22. The drawing depicts a generally rectangular cross section for the tubular member but this can be any shape as long at the carriage can ride within the tubular member. The mast is shown in connection with a fork lift apparatus in FIG. 1 but can actually be used in a number of different applications. Front wall 22 of the mast has a pair of side members 23 and 24 that extend from the sidewalls and which define the slot 25. Slot 25 determines the path of travel of the carriage 16 within the mast. Extending from the first side member 23 toward the second side member 24 is a first connection means 26. Extending from the second side member 24 toward the first member is second connection means 27. Joining the first and second connection means is slot cover 28.

Figure 7:
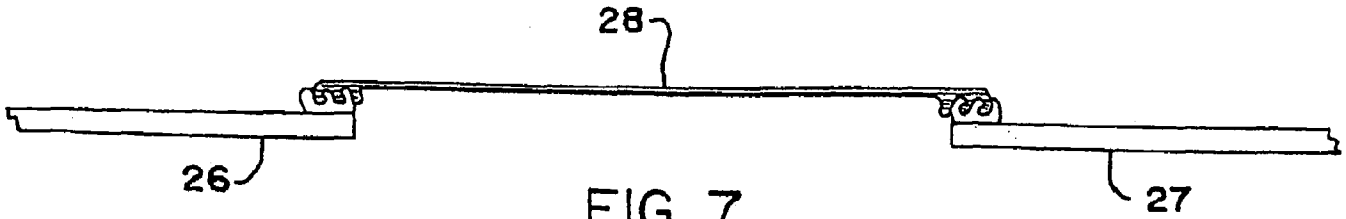
FIG. 7 shows an alternative arrangement of the cover assembly of the present invention with the cover engaged.
Figure 6:
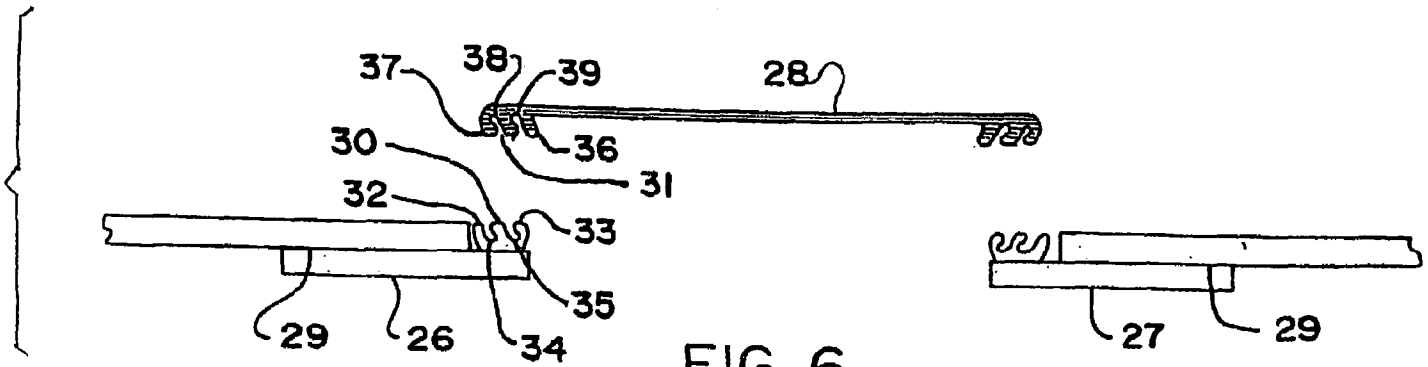
FIG. 6 shows the cover assembly of the present invention with the cover disengaged.
Figure 5:
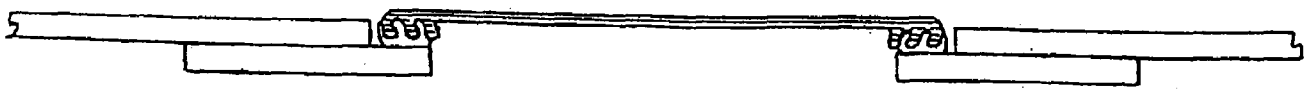
FIG. 5 shows the cover assembly of the present invention with the cover engaged.
Figure 8:
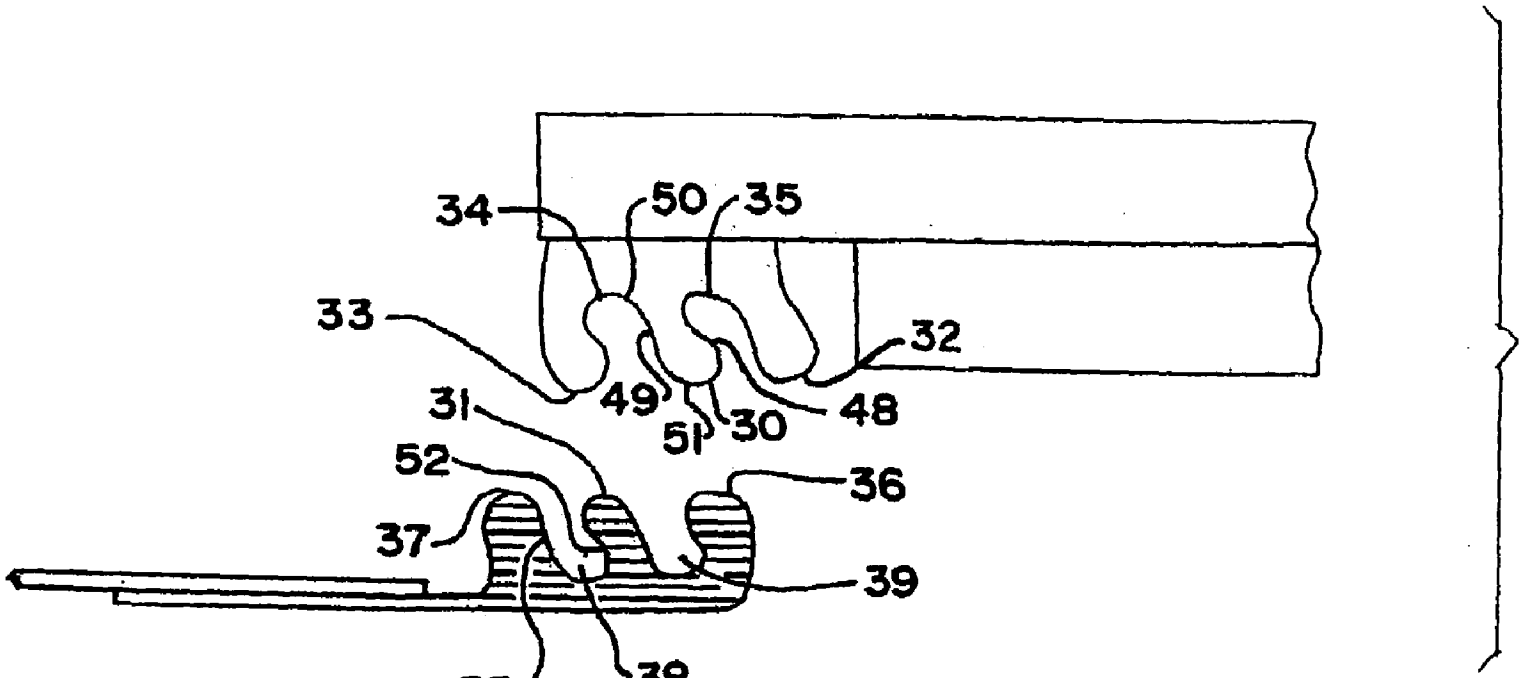
FIG. 8 shows the side profile of a connecting member and a receiving member of the present invention.

The connection means 26 and 27 each may have a securing surface 29 for securing the connection means to the side member. The connection means has at least one connecting member 30 that mates with receiving member 38 on the slot cover 28. Alternatively, the slot cover may have the connecting member that mates with a receiving member on the connection means. In a preferred embodiment of the invention the connection means has a three connecting members 30, 32 and 33. The three connecting members 30, 32 and 33 are separated by receiving members 34 and 35. Similarly, the slot cover is provided with three connecting members 31, 36 and 37. The connecting members 31, 36 and 37 are separated by receiving members 38 and 39. The connection means may be a separate member from the flange or it may be an integral part thereof as depicted in FIG. 7.

Figure 3:
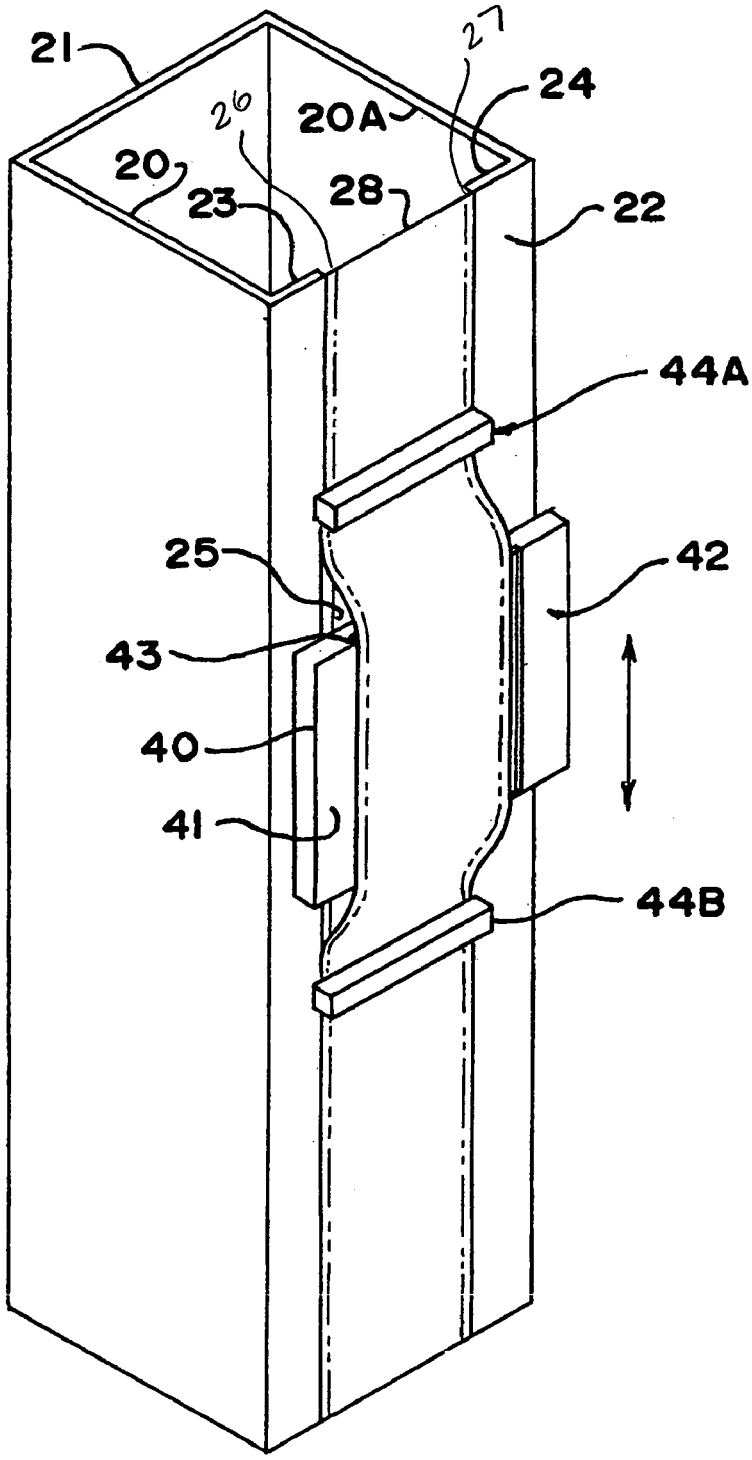
FIG. 3 shows a portion of the cover assembly of the present invention.

As shown in FIG. 3 as the carriage rises and falls in the slot the cover guide 40 which is connected to the carriage also rises and falls. The cover guide is generally a plate like member being generally rectangular in configuration. Support wings 41 and 42 are on either side of the cover guide and provide a surface for connecting the accessory mount means 19 to the cover guide 40. The cover guide is preferably designed so that the cover guide has a recessed portion 43 in which the cover passes during movement of the carriage. As the cover guide moves along its path, the cover guide lifts the cover and causes the mated connecting members 31, 36 and 37 to become separated from receiving members 34 and 35. Similarly, the mated connecting members 30, 32 and 33 are also caused to become separated from receiving members 38 and 39. As the cover guide travels downwardly along the slot, the raised portion of the slot cover is pressed into engagement with the connection means by the pressure bar 44B. Similarly, as the cover guide travels upwardly along the slot, the raised portion of the slot cover is pressed into engagement with the connection means by the pressure bar 44A. As can be seen from FIG. 3 the slot cover prevents ingress of debris and moisture into the mast thus eliminating the problem of the prior art designs. In addition, the slot cover prevents injury to hands and fingers due to the movement of the carriage in the slot.

Figure 4:
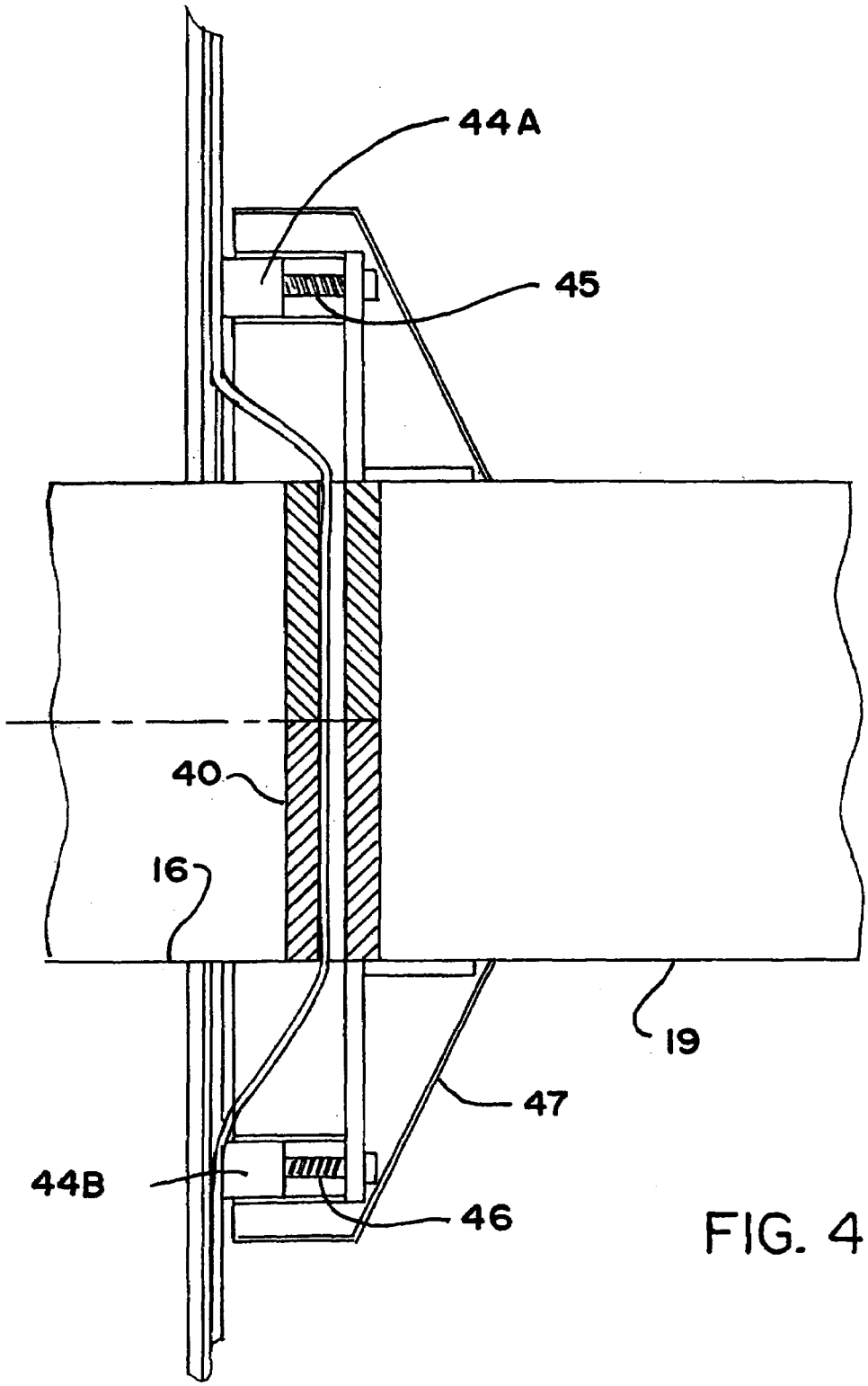
FIG. 4 shows a side cutaway view of the cover assembly of the present invention.

FIG. 4 shows the side view of the arrangement of the carriage 16, cover guide 40 and the accessory mount 19 in the present invention. The carriage 16 is connected to the cover guide by any suitable means. In one embodiment the carriage and cover guide may be a single member. The cover guide is connected to the accessory mount 19. The pressure bars 44A and 44B are retained in position by springs 45 and 46. Preferably the springs are adjustable and/or replaceable to provide the necessary force to reconnect the slot cover as the carriage makes its travels. The assembly may be further protected by a cover 47.

The slot cover is preferably made of a flexible plastic material as are the connection means. Preferably the connecting members 30–33 and 36–37 are provided with a cross section that mates with the shape of the receiving members 34,35, 38 and 39. In a preferred embodiment the connecting members have sides 48 and 49 a base 50 and a top surface 51. Preferably, the side 48 is generally concave and side 49 is generally straight or convex giving the connecting member a stocking like profile. The receiving members are also preferably a similar configuration. Specifically, the receiving member has sides 52 and 53 a base 54. Preferably, the side 52 is generally concave and side 53 is generally straight or convex giving the receiving member and the connecting member a stocking like profile. Alternatively, the receiving members may have a different profile provided that they mate together to provide a proper fit to secure the slot cover to the connection means. Although the present invention has particular advantages when used with fork lifts it also has applicability when used in other applications such as in the field of medical diagnostics where the accessory mount 19 has for example a medical diagnostic device such as a scanner connected thereto such that the diagnostic device travels along a slot that is provided with a slot cover in accordance with the present invention.

I claim:

1. A slot covering mechanism for a forklift having a hollow elongated member, a moving carriage and an accessory mounting means connected to said carriage which travels in a slot in said hollow elongated member said hollow elongated member having a front wall having first and second side members, said first and second side members on said front wall defining said slot, each said side members having a connection means extending therefrom and a single slot cover joining said connection means, said connection means for securing said slot cover to said side members, said carriage having a cover guide connected thereto which moves with said carriage, said cover guide causing the connection means to become separated from said slot cover as said cover guide travels along said slot, the portion of the slot cover separated from the connection means being pressed into engagement with the connection means as said cover guide continues to travel along the slot; and wherein said cover guide has a support wing on either side of the cover guide separated by a recess portion in which the cover passes during movement of the carriage.

2. The slot covering mechanism according to claim 1 wherein the cover guide is a plate member being generally rectangular in configuration.

3. The slot covering mechanism according to claim 2 wherein said support wings provide a surface for connecting said accessory mounting means to the cover guide.

4. The slot covering mechanism according to claim 3 wherein the separated portion of the slot cover is pressed into engagement with the connection means by a pressure bar.

5. The slot covering mechanism according to claim 4 wherein said pressure bar is retained in position by springs.

6. A slot covering mechanism for an apparatus having a elongated hollow member, moving carriage and an accessory mounting means connected to said carriage which travels in a slot, in said elongated hollow member said elongated hollow member having a front wall having first and second side members said first and second side members on said front wall defining said slot, each said side members having a connection means extending therefrom and a single slot cover joining said connection means, said connection means for securing said slot cover to said side members, said carriage having a cover guide connected thereto which moves with said carriage, said cover guide causing the connection means to become separated from said slot cover as said cover guide travels along said slot, the portion of the slot cover separated from the connection means being pressed into engagement with the connection means as said cover guide continues to travel along the slot; and wherein said cover guide has a support wing on either side of the cover guide separated by a recess portion in which the cover passes during movement of the carriage.

7. The slot covering mechanism according to claim 1 wherein said elongated hollow member is tubular member.

8. The slot covering mechanism according to claim 7 wherein said elongated hollow member has a pair of sidewalls that join a rear wall to said front wall.

9. The slot covering mechanism according to claim 8 wherein the connection means has at least one connecting member that mates with a receiving member on the slot cover.

10. The slot covering mechanism according to claim 9 wherein the connection means has a three connecting members separated by two receiving members and said slot cover is provided with three connecting members separated by two receiving members.

11. The slot covering mechanism according to claim 8 wherein the slot cover has a connecting member that mates with a receiving member on the connection means.

12. The slot covering mechanism according to claim 6 wherein said elongated hollow member is tubular member.

13. The slot covering mechanism according to claim 12 wherein said elongated hollow member has a pair of sidewalls that join a rear wall to said front wall.

14. The slot covering mechanism according to claim 13 wherein the connection means has at least one connecting member that mates with a receiving member on the slot cover.

15. The slot covering mechanism according to claim 14 wherein the connection means has a three connecting members separated by two receiving members and said slot cover is provided with three connecting members separated by two receiving members.

16. The slot covering mechanism according to claim 13 wherein the slot cover has a connecting member that mates with a receiving member on the connection means.

17. The slot covering mechanism according to claim 6 wherein the cover guide is a plate member being generally rectangular in configuration.

18. The slot covering mechanism according to claim 17 wherein said support wings provide a surface for connecting said accessory mounting means to the cover guide.

19. The slot covering mechanism according to claim 18 wherein the separated portion of the slot cover is pressed into engagement with the connection means by a pressure bar.

20. The slot covering mechanism according to claim 19 wherein said pressure bar is retained in position by springs.

* * * * *